United States Patent [19]

Nigrelli, Sr.

[11] Patent Number: 4,982,551

[45] Date of Patent: Jan. 8, 1991

[54] UNIVERSAL PACKER

[75] Inventor: Biagio J. Nigrelli, Sr., Kiel, Wis.

[73] Assignee: Nigrelli System, Inc., Kiel, Wis.

[21] Appl. No.: 297,253

[22] Filed: Jan. 17, 1989

[51] Int. Cl.[5] ..... B65B 35/44; B65B 35/54; B65B 43/32

[52] U.S. Cl. ..... 53/55; 53/543; 53/566; 53/251

[58] Field of Search ..... 53/55, 57, 48, 543, 53/566, 251, 247; 271/134, 105

[56] References Cited

U.S. PATENT DOCUMENTS

| | | | |
|---|---|---|---|
| 3,058,271 | 10/1962 | McGihon | 53/48 X |
| 3,097,463 | 7/1963 | Neal et al. | 271/134 X |
| 3,105,337 | 10/1963 | Clanin et al. | 53/251 |
| 3,273,306 | 9/1966 | Maclennan | 53/55 X |
| 3,300,947 | 1/1967 | Fahrenbach | 53/48 |
| 3,333,514 | 8/1967 | Jones | 53/566 X |
| 3,778,959 | 12/1973 | Langen et al. | 53/251 X |
| 3,956,868 | 5/1976 | Ganz et al. | 53/251 X |
| 4,041,677 | 8/1977 | Reid | 53/543 |
| 4,237,673 | 12/1980 | Calvert et al. | 53/251 X |
| 4,526,564 | 7/1985 | Hughes | 53/566 X |
| 4,693,055 | 9/1987 | Olsen, Jr. et al. | 53/251 X |
| 4,709,538 | 12/1987 | Olsen, Jr. et al. | 53/566 |
| 4,756,139 | 7/1988 | Le Bras | 53/543 X |
| 4,875,323 | 10/1989 | Craighead | 53/566 X |

*Primary Examiner*—Horace M. Culver

*Attorney, Agent, or Firm*—Fuller, Ryan & Hohenfeldt

[57] ABSTRACT

A universal packer unfolds folded open side container blanks into fully opened containers and side loads them with complements of articles. The blanks are metered by a supply station and are propelled downstream to an unfolding station. The container flaps are spread apart, and expander arms enter the interior of each blank, thereby starting to unfold it. Erector arms strike the partially opened blank at the trailing edge thereof and push the trailing edge downward relative to the blank leading edge, thereby continuing the unfolding process. Drop lug assemblies emerge from under the blank trailing panel and pivot from a horizontal to a vertical attitude while in contact with the blank trailing panel, thereby completely unfolding the blank. Simultaneously with blank unfolding, a pair of grouper mechanisms forms the complements from a mass of the articles. The complements are propelled downstream in unison and aligned with the open containers. A pusher bar system assists in positively restraining the container flaps and also succeeds the grouper mechanism in propelling the complements downstream. Guide plates direct the complements into the container open sides as the complements are propelled by the pusher bar system.

27 Claims, 6 Drawing Sheets

Fig 3

UNIVERSAL PACKER

BACKGROUND OF THE INVENTION

1. Field of the Invention

This invention pertains to loading containers, and more particularly to apparatus for unfolding container blanks and side loading the open containers with complements of articles.

2. Description of the Prior Art

Machines of different types are presently available for filling bottles and cans on a high speed production basis. After being filled, the bottles or cans must be loaded into containers for shipping. Loading bottles and cans into suitable containers at speeds corresponding to those of the filling machines poses difficult problems.

The containers are usually supplied to the bottling plants in the form of folded paperboard blanks of various constructions, so the blanks must be unfolded before the bottles or cans can be loaded into them. U.S. Pat. No. 4,685,275 and U.S. Pat. No. 4,633,655 show exemplary apparatus for unfolding container blanks and for loading the open containers with complements of articles. Although the machines of the aforementioned patents work very well, they nevertheless are subject to improvement. Further, it has been found desirable to improve the manner in which complements are formed from a large quantity of randomly arranged articles.

SUMMARY OF THE INVENTION

In accordance with the present invention, a universal packing machine is provided that continuously unfolds container blanks and loads the open containers with complements of articles in a high speed manner. This is accomplished by apparatus that includes several sets of rotating arms that cooperate to unfold the container blanks, together with two sets of groupers that separate the articles into correct complements for loading into the open containers.

The containers are folded into blanks having two layers. The upper layer consists of the container leading and top panels and their respective flaps. The lower layer consists of the bottom and trailing panels and their respective flaps. Stacks of horizontally oriented blanks are deposited into a feed hopper at a supply station. The feed hopper includes means for metering the blanks from the stack. One blank at a time is stripped from the stack by stripper lugs that strike the blank trailing edge. The blanks are propelled along an elongated frame in a downstream direction along an unfolding path to an unfolding station. The blank flaps extend perpendicular to the direction of downstream motion.

At the unfolding station, a first set of rotating arms pushes downwardly on the blank top flaps, thereby also pushing downwardly on the underlying bottom flaps. The blank bottom flaps pass under stationary plows. Tabs on the plows bend the top flaps upwardly above the bottom flaps, thereby creating gaps between corresponding top and bottom flaps. A pair of expander arms, rotating about respective vertical axes, enter the blank from each side between the separated top and bottom flaps and extend between the top and bottom panels. The expander arms have tapered leading edges that force the top and bottom panels apart. In that manner, the expander arms start to unfold the blank into a parallelogram shape. The expander arms rotate at a speed such that the outer peripheries thereof have linear speeds greater than the speed of the stripper lugs and blanks in the downstream direction.

As the blank is being unfolded by the expander arms, a pair of erector arms, rotating about a horizontal axis, contacts the blank trailing edge, which was raised above the stripper lugs by the expander arms. The linear speed of the erector arms is greater than that of the stripper lugs, so that the erector arms push the blank against the adjacent downstream stripper lugs and into a more fully unfolded configuration. At that point, a drop lug assembly traveling in unison with the stripper lugs emerges from under the partially unfolded container to pivot to a vertical attitude against the container trailing panel. As the drop lug assembly reaches the vertical attitude, it pushes the container to the fully opened configuration. The container then enters a flap control station.

Simultaneously with the unfolding of the container blanks, the articles to be loaded into the containers are conveyed along infeed paths on both sides of the container unfolding path by an infeed system to a grouper station. The infeed system includes guide plates for channeling the articles in each infeed path into a desired number of columns. At the grouper station, the articles in each infeed path are formed into complements of the desired number of articles.

The grouper station comprises two pairs of groupers. A primary pair of groupers operates to capture a selected number of articles from each of the two paths of massed articles. Each primary grouper comprises one or more chains with suitable pins that travel under the articles to penetrate upwardly between them at the proper location for forming the complements. The primary groupers are designed to form complements only if a container is present at the blank unfolding station and if a sufficient number of articles is present at the grouper station to form a proper complement. A sensing system operates the primary groupers to stop chain and pin motion unless both a container and a proper number of articles are present at their respective locations. The primary groupers propel the complements downstream a short distance to a transfer point. At the transfer point, a pair of secondary groupers, which also comprise one or more chains with pins located generally under each infeed path of articles, contacts the associated complements and propels them in the downstream direction. The timing and dimensions of the container unfolding and article grouping portions of the universal packer are such that the pairs of complements are transversely aligned with and travel in unison with an open container downstream from the container unfolding station and the article grouping station.

The container and complements next are engaged by an overhead pusher bar system. The pusher bar system functions to take over propelling the complements from the secondary groupers. The pusher bar system also cooperates with flap tucking components mounted to the universal packer frame at the flap control station to positively control the container flaps.

At the flap control station, rapidly rotating arms push the leading flaps into tucked engagement with respective fingers on a pusher bar adjacent and downstream of the container. Frame mounted cams bend the container trailing flaps into respective slots on a pusher bar that is upstream and adjacent the container. Suitable stationary plows mounted to the universal packer frame positively control the container top and bottom flaps. At that point, the container is ready to be loaded at a loading station.

At the loading station, the article guide plates converge in the downstream direction, thereby forcing the complements on each side of the container toward each other and into the container. The fully controlled flaps of the container enable it to be reliably side loaded at high speeds without interference from the flaps. When loaded, a high speed closer arm folds the container trailing flaps to the closed configuration. Suitable plows bend the container leading, top, and bottom flaps to their respective closed configurations. Glue is applied to the flaps by suitable means, and the loaded container is ready for inspection and shipment.

Other objects and advantages of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1A:
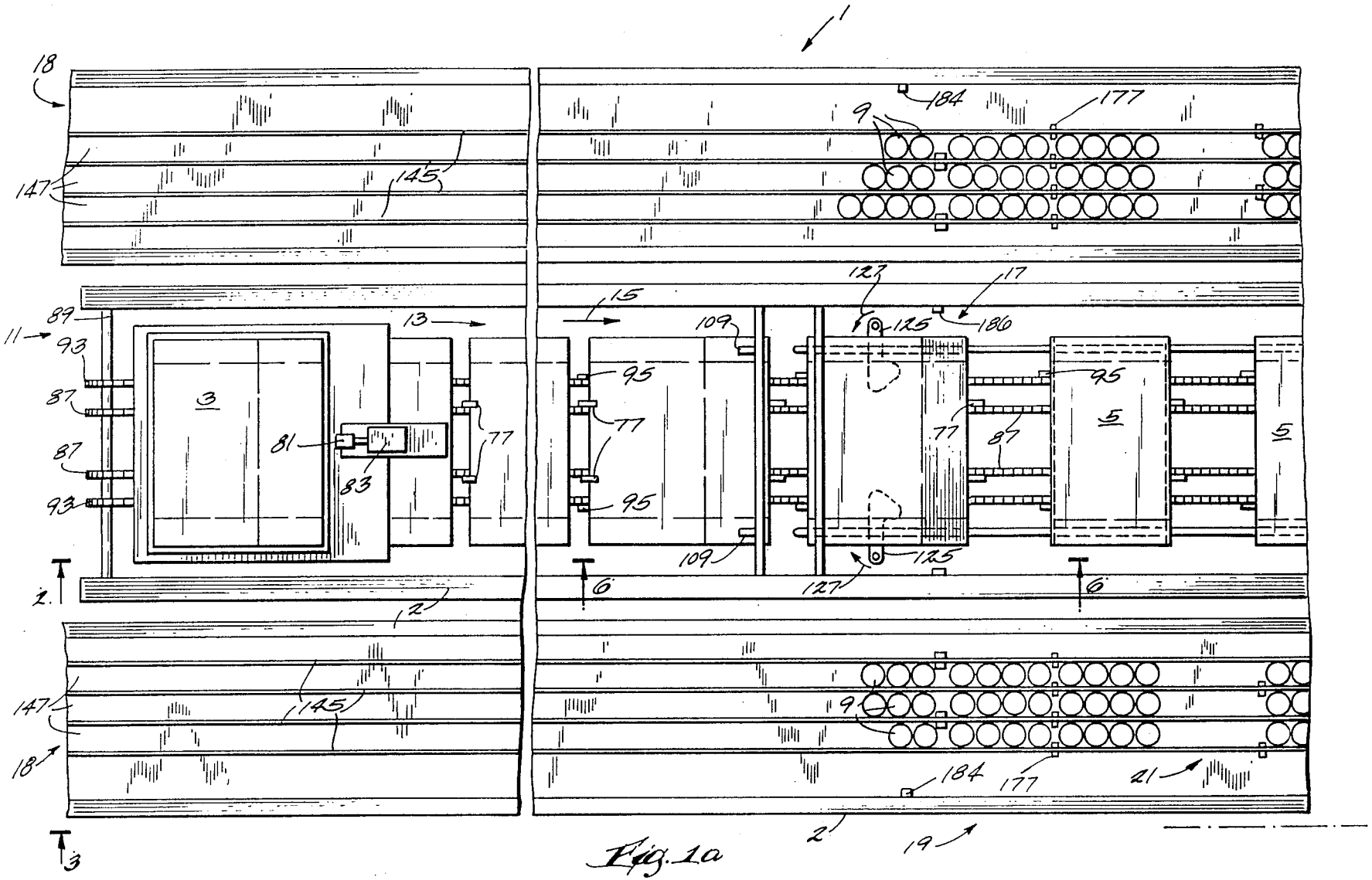
FIG. 1*a* is a top view of the universal packer of the present invention.
Figures 1B, 3:
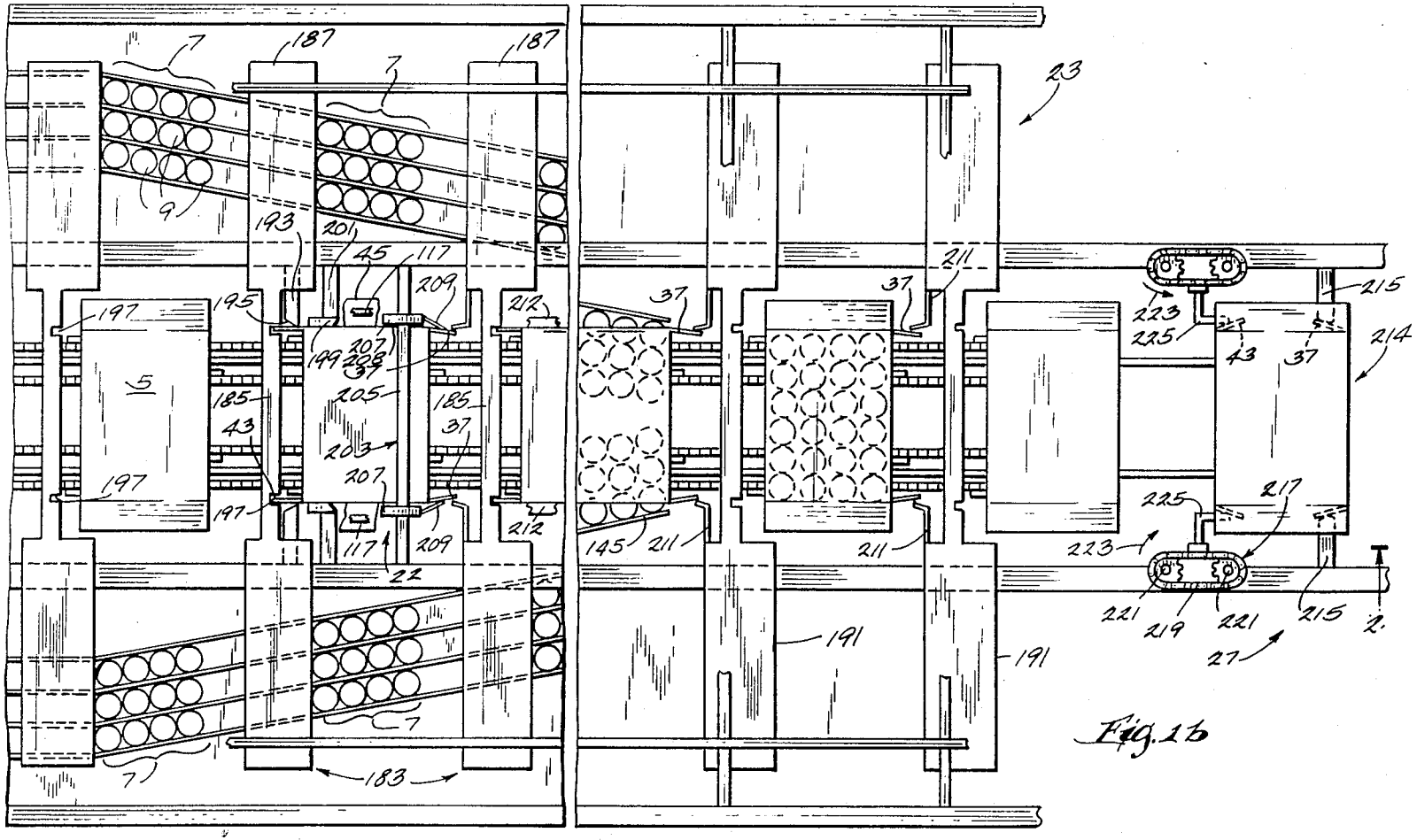
FIG. 1*b* is a continuation of FIG. 1*a* showing additional top view structure of the present invention.
FIG. 3 is a view taken along lines 3—3 of FIGS. 1*a* and 1*b*.
Figure 2:
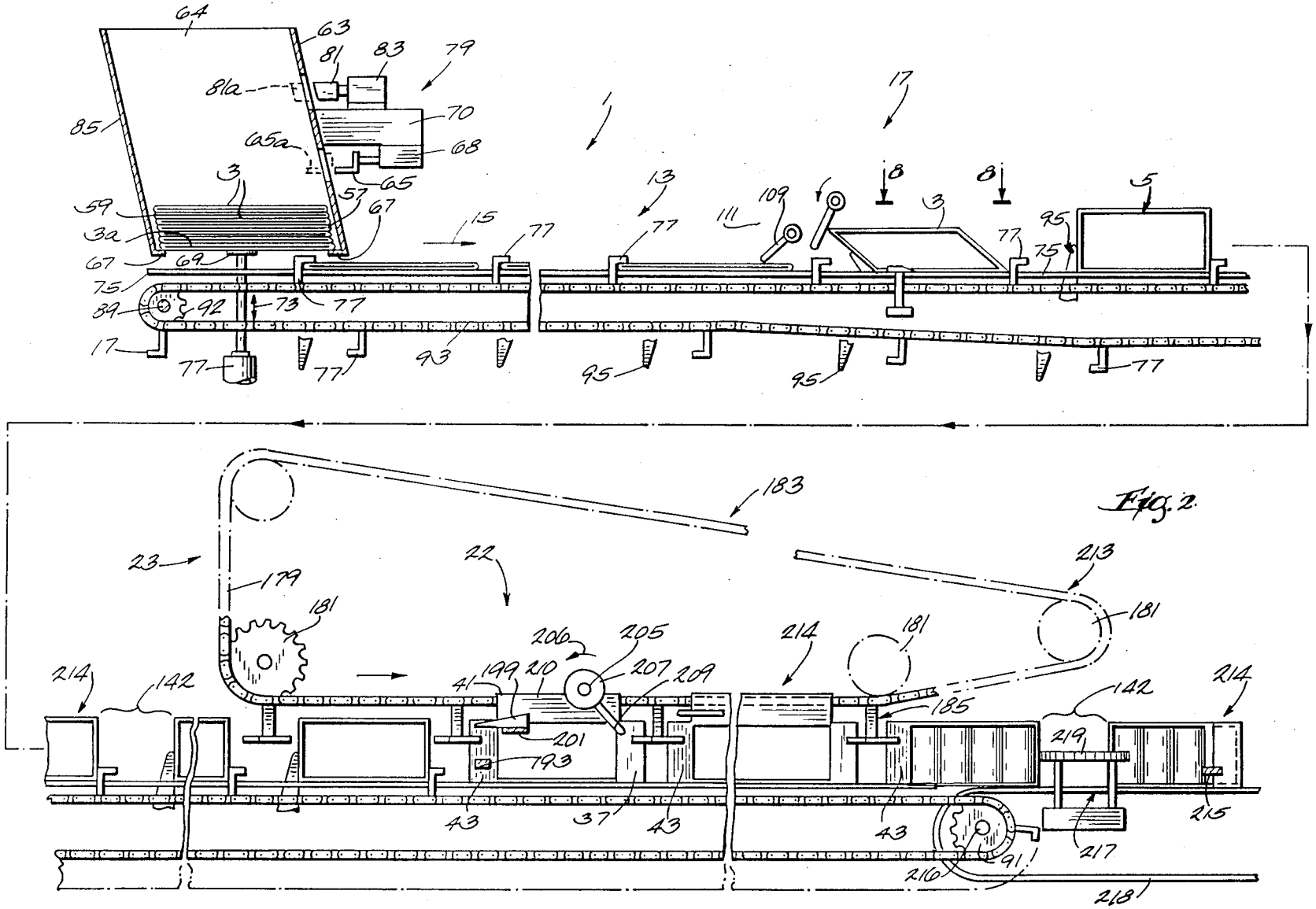
FIG. 2 is a partially broken view taken along lines 2—2 of FIGS. 1*a* and 1*b*.
Figure 3:
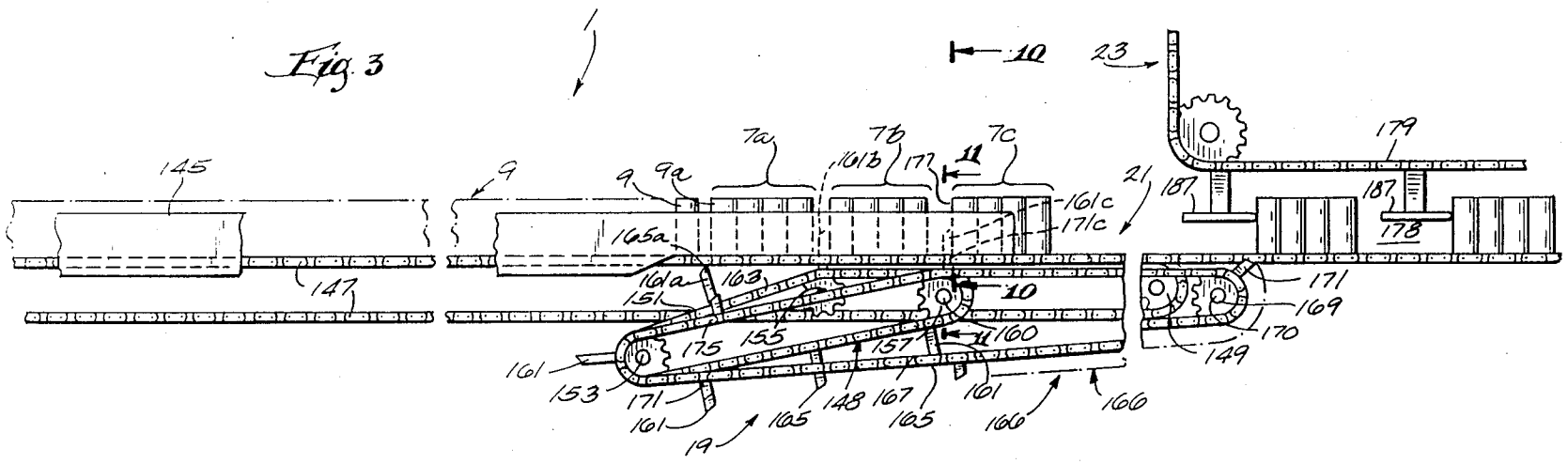

Referring to FIGS. 1–3, a universal packer 1 is illustrated that includes the present invention. The universal packer is particularly useful for unfolding open side container blanks 3 into fully open containers 5 and for loading the open containers with complements 7 of upright articles 9.

General

The universal packer 1 is composed of a sturdy frame 2 that supports a blank supply station 11. At the blank supply station 11, the container blanks 3 are metered onto a conveyor system 13. The conveyor system 13 propels the blanks downstream along an unfolding path in the direction of arrow 15, that is, from left to right in FIGS. 1–3. The blanks are propelled with their flaps extending perpendicular to the direction of downstream motion 15. The conveyor system 13 propels the blanks through an unfolding station 17, where the blanks are unfolded to form the open side containers 5.

The articles 9 to be loaded into the open side containers 5 travel in the direction of arrow 15 in two parallel paths 18. The article paths 18 straddle the conveyor system 13. At a location approximately transversely aligned with the blank unfolding station 17, the articles are formed into the complements 7 at a grouper station 19. From the grouper station 19, the complements are propelled downstream by a pin and chain system 21 in unison with and transversely aligned with respective open containers 5, which remain propelled by the conveyor system 13.

From the pin and chain system 21, propulsion of the complements 7 is transferred to an overhead pusher bar system 23. The pusher bar system 23 and the complements propelled thereby travel in unison with the open containers 5 to a flap control station 22. At the flap control station 22, the pusher bar system and various flap tucking components mounted to the universal packer frame 2 positively restrain the container flaps in controlled locations. With the container flaps under positive restraint, the pusher bar system propels the complements in unison with the conveyor system 13 and containers to a loading station 25.

At the loading station 25, the complements 7 are simultaneously side loaded into the containers 5 from both article paths 18. From the loading station 25, the loaded containers 214 are propelled onto a secondary conveyor 218 to a closing station 27. At the closing station 27, the container flaps are closed and glued. The loaded containers 214 are then passed to additional equipment for inspection and shipping.

Container

Figure 4A:
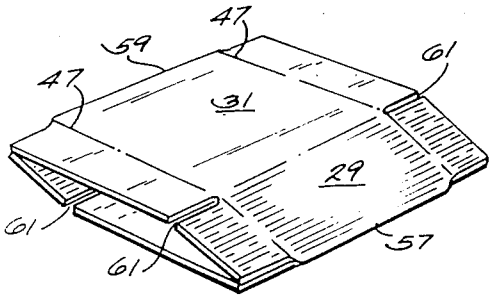
FIGS. 4 and 4*a* are perspective views of a fully opened and partially opened, respectively, open side container that is advantageously handled and loaded by the present invention.
Figure 4:
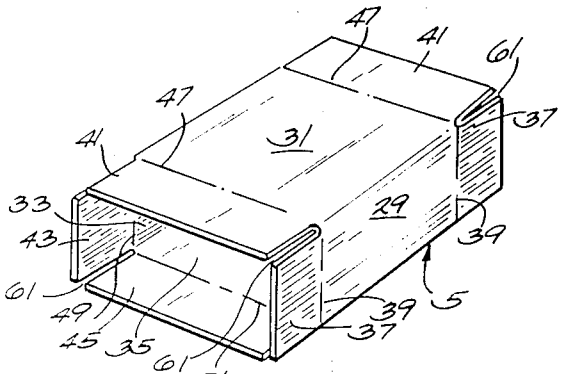
Figure 9C:
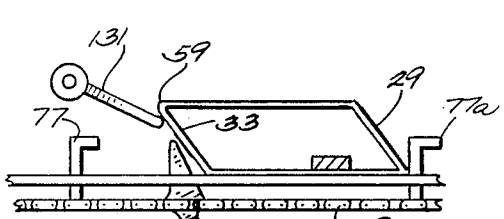
FIGS. 9*a*–9*e* are enlarged views taken generally along lines 6—6 of FIG. 1*a* showing additional components and operations pertaining to the final stages of the unfolding of a container blank according to the present invention.
Figure 9B:
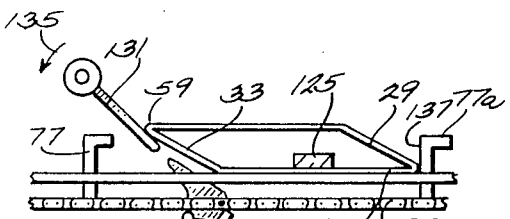
Figure 9A:
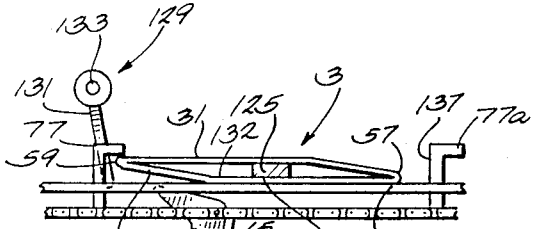
Figure 9E:
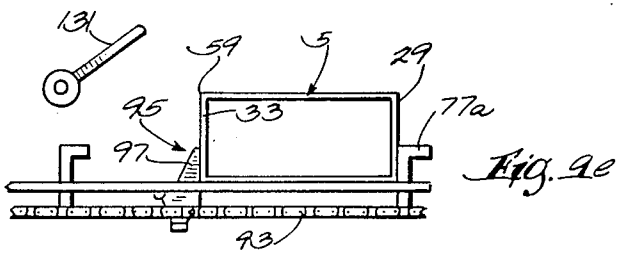
Figure 9D:
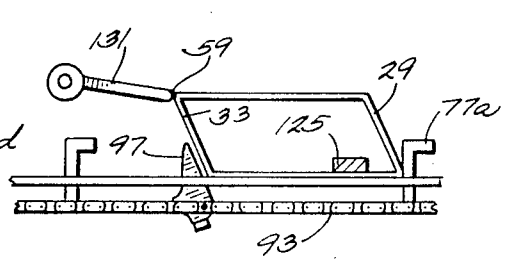

Turning to FIGS. 4 and 4*a*, the container 5 is composed of a leading panel 29, a top panel 31, a trailing panel 33, and a bottom panel 35. The leading panel 29 terminates in oppositely extending flaps 37, to which it is connected by respective fold lines 39. Similarly, the top, trailing, and bottom panels 31, 33, and 35, respectively, terminate in oppositely extending flaps 41, 43, and 45, respectively. Respective fold lines 47, 49, and 51 join the flaps 41, 43, and 45 to their respective panels 31, 33, and 35. Slits 61 separate the various adjacent flaps.

Figure 5:
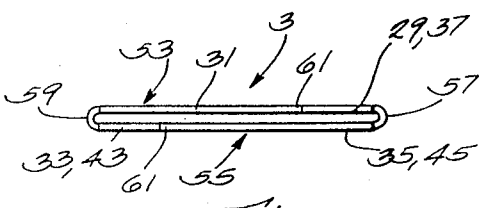
FIG. 5 is an end view of the container of FIGS. 4 and 4*a*, but showing the container folded into a blank.

FIG. 5 shows an end view of the container 5 folded into a blank 3. The blank is folded such that the leading panel 29 and top panel 31, together with their respective flaps 37 and 41, form an upper layer 53. The blank further has a lower layer 55 composed of the trailing panel 33 and bottom panel 35, together with their respective flaps 43 and 45. For clarity, an exaggerated space is shown between the blank upper layer 53 and the lower layer 55. When folded, the fold line 57 between the carton bottom and leading panels is termed the leading edge, and the fold line 59 between the top and trailing panels is termed the trailing edge.

Supply Station

Returning to FIGS. 1 and 2, at the universal packer supply station 11 stacks of container blanks 3 are loaded into a hopper 63. Preferably, the hopper 63 is slanted downwardly in the downstream direction 15. Hopper loading may be achieved through automatic machinery that drops pre-stacked bundles of blanks into the hopper mouth 64. The blanks are loaded such that their leading edges 57 (FIGS. 4 and 5) are facing in the downstream direction 15. The blanks may be supported on the bottom of the hopper by inturned lips 67.

The bottommost blank 3*a* is pulled downwardly past the lips 67 by a vacuum cup 69 connected to the end of a fluid cylinder 71. The fluid cylinder 71 operates to reciprocate the vacuum cup 69 in the directions of arrow 73. Downward motion of the cylinder and vacuum cup 69 is timed with the operation of the conveyor system 13. The vacuum cup withdraws the bottommost blank 3*a* onto support rails 75 fastened to the universal packer frame 2 just as a pair of hooked stripper lugs 77 approach the supply station 11 from the upstream direction. As the blank 3*a* is pulled downwardly by the vacuum cup, the stripper lugs 77 strike the blank trailing edge 59.

To assure proper withdrawal by the vacuum cup 69 of the bottommost blank 3*a* from the lips 67 against the friction produced by the superimposed blanks in the hopper 63, the present invention includes a blank metering device 79. In the illustrated construction, the metering device 79 comprises a ledge 65 connected to the piston rod of a fluid cylinder 68. The fluid cylinder 68 is mounted by a bracket 70 to the hopper 63. The cylinder 68 operates to reciprocate the ledge 65 between an extended position 65*a* where the ledge is within the hopper and a retracted position where the ledge is withdrawn outside the hopper. When in the extended position 65*a*, blanks 3 loaded into the hopper mouth 64 are prevented from falling to the hopper bottom lips 67.

Cooperating with the ledge 65 is a grooved gripper 81. The gripper 81 is connected to the piston rod of a fluid cylinder 83. Operation of the fluid cylinder 83 causes the gripper 81 to reciprocate between a retracted position where it is outside of the hopper and an extended position 81*a* where the gripper is inside the hopper. In operation, the cylinder 68 is normally actuated to extend the ledge 65 into the hopper 63 to the position 65*a*. The cylinder 83 is normally actuated to retract the gripper 81 outside the hopper. In those respective positions, as many blanks 3 as desired may be loaded into the hopper 63, but only the weight of any previously loaded blanks below the ledge 65 is supported by the lips 67. When a conventional sensing device, not shown, senses that a predetermined few number of blanks remain supported by the lips 67, the cylinder 83 is actuated to extend toward the position 81*a*. Doing so causes the grooves in the gripper to engage the leading edges 57 of several blanks and to push those blanks against the opposite hopper wall 85. Then the cylinder 68 is actuated to retract the ledge 65. As a consequence, the blanks located between the gripper and ledge fall by gravity to the hopper lips 67, but the blanks engaged by the gripper and the blanks above the gripper remain supported by the gripper and do not fall. Next, the ledge is extended to position 65*a*, and the gripper is retracted. All the blanks supported by the gripper then fall to rest on the ledge. The blanks remain supported on the ledge until the supply supported on the lips 67 is again almost used up, at which time the cycle is repeated. In that manner, a predetermined maximum number of blanks are supported by the lips 67, thereby assuring reliability in stripping the bottommost blanks 3*a* from the hopper 63.

Conveyor System

As mentioned previously, blanks 3 are stripped from the hopper 63 at the supply station 11 by pairs of hooked stripper lugs 77. The stripper lugs are joined at fixed intervals to respective chains 87. The chains are trained around tail sprockets on a shaft 89 and around similar sprockets fastened to a head shaft 216. The shafts 89 and 216 are mounted in the universal packer frame 2 for rotation, with power being supplied to the head shaft 216 from a suitable drive mechanism, not illustrated in FIGS. 1 and 2. In operation, the upper flights of the chains 87 and stripper lugs travel in the direction of arrow 15 to propel the stripped blanks downstream.

The head shaft 216 also provides power to a second pair of sprockets 91 for driving associated chains 93 in unison with the chains 87. Pivotally connected to the chains 93 at spaced intervals therealong are a series of pairs of drop lug assemblies 95. Also see FIG. 6. Each drop lug assembly 95 comprises a drop lug 97 connected by a pin 99 to a suitable link on the chain 93. Each drop lug 97 is formed with an arm portion 101 that supports a cam follower 103. A foot 105 is bent over from the plane of the drop lug 97 to overlie the chain.

Figure 6:
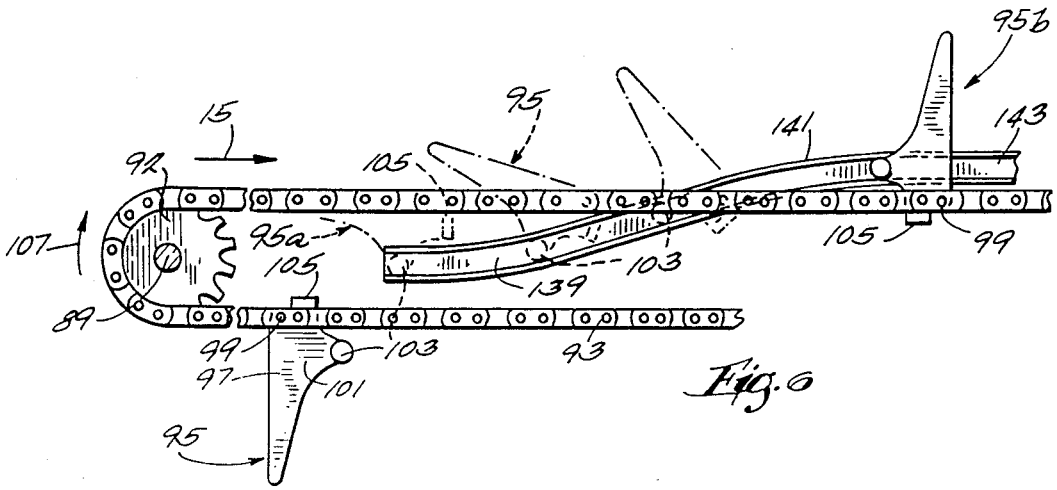
FIG. 6 is an enlarged partial view taken along lines 6—6 of FIG. 1*a* and showing a portion of the path of the drop lug assemblies.
Figure 7A:
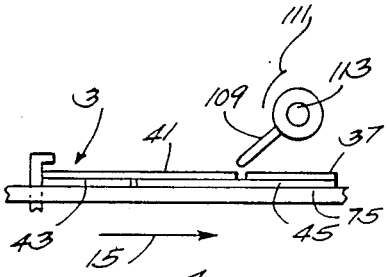
FIGS. 7*a*–7*e* are enlarged views taken generally along lines 6—6 of FIG. 1*a* showing components and operations pertaining to the initial stages of the unfolding of an open side container blank.
Figure 7B:
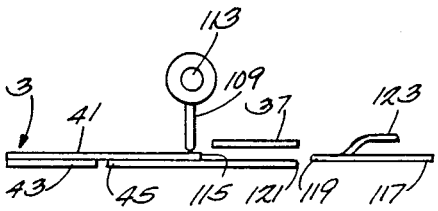
Figure 7C:
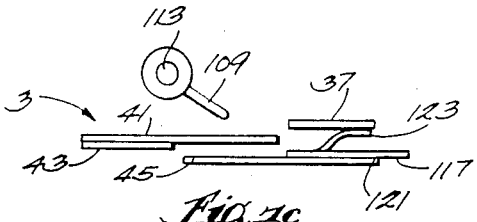
Figure 7D:
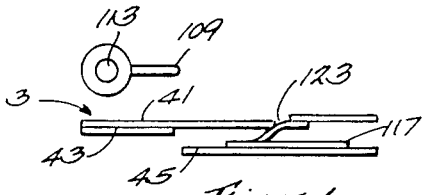

With particular attention to FIGS. 2 and 6, the drop lugs 97 on the lower flights of the chains 93 are oriented by gravity to generally vertical attitudes. As the drop lugs pass over the tail sprockets 92 in the direction of arrow 107, gravity causes them to pivot about the pins 99 to inoperative positions wherein they are in generally horizontal attitudes, such as is indicated by drop lug assembly 95*a*. The feet 105 bearing against the undersides of the chains 93 locate the drop lug assemblies 95*a* in the inoperative horizontal attitude.

Unfolding Station

From the supply station 11, the blanks 3 are propelled downstream by the stripper lugs 77 in the direction of arrow 15 to the unfolding station 17. FIGS. 7*a*–7*e* show the variations in positions of the container flaps 37, 41, 43, and 45 relative to the container support rails 75 during the initial phase of the unfolding process. For clarity, the support rails are not shown in FIGS. 7*b*–7*e*. Similar components perform the same process on the flaps on both sides of the blank, so a description of the process and components associated with only one side of the blank is necessary. The locations of the blank panels 29, 31, 33, and 35 relative to the support rails do not change during the initial unfolding process associated with FIGS. 7*a*–7*e*. Accordingly, for clarity, the blank panels are not shown in FIGS. 7*a*–7*e*.

Reference numeral 109 represents an unfolding arm that rotates in the direction of arrow 111 about a horizontal shaft 113. Shaft 113 is mounted in the universal packer frame 2. The rotation of the shaft 113 and arm 109 is timed with the movement of the stripper lugs 77 and the blank 3 such that the tip of the arm is in the vertical orientation of FIG. 7*b* just as the leading edge 115 of the top flap 41 passes under the shaft 113. The arm 109 is dimensioned to push down on the top flap 41 and bend it along the fold line 47 (FIGS. 4 and 4*a*). Bending the top flap also causes the flaps 43 and 45 of the blank lower layer 55 to bend downwardly about their respective fold lines 49 and 51. The leading flap 37 is not affected by the arm 109.

Located downstream of the arm 109 is a plow 117 mounted to the universal packer frame 2. The upstream end 119 of the plow 117 is positioned close to and slightly above the leading edge 121 of the blank bottom flap 45 when the blank bottom flap is bent downwardly by the arm 109. Accordingly, continued downstream motion of the blank causes the bottom flap 45 to be caught under the plow, FIG. *7c*. After the arm 109 has broken contact with the top flap 41, both the top flap and the trailing flap 43 relax to the respective positions they occupied prior to being bent by the arm, that is, generally coplanar with the top and trailing panels 31 and 33, respectively. Relaxation of the flaps 41 and 43 causes them to pass over the plow, FIGS. *7d* and *7e*.

Downstream of the upstream end 119 of the plow 117 is a bent-up tab 123. As the blank upper layer 53 passes the tab 123, the tab bends the blank flaps 37 and 41 of the upper layer upwardly about the respective fold lines 39 and 47. Ultimately, the leading flap 37 passes the tab. However, as shown in FIG. *7e*, the combination of the tab holding the top flap 41 upwardly and the plow 117 holding the bottom flap 45 downwardly functions to positively control the locations of those flaps and to form a vertical gap G between them. Positive flap location and gap G creation are very important, because the gap provides a well defined entrance into the interior of the blank for a pair of expander arms 125, as will now be explained.

Figure 8A:
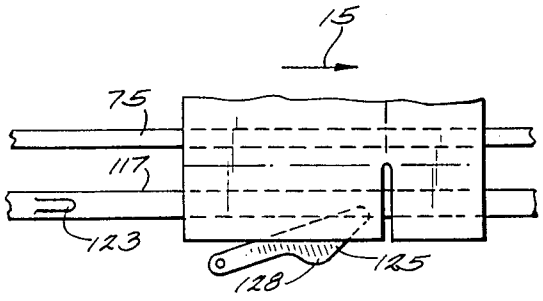
FIGS. 8 and 8*a* are enlarged views taken generally along lines 8—8 of FIG. 2 showing certain stages in the unfolding of the container blank.
Figure 8:
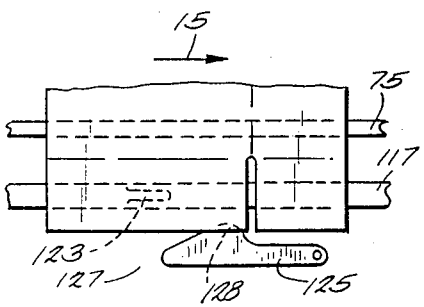

Also looking at FIG. 8, that figure may be considered to be a top view cf FIG. *7e*. Mounted to the universal packer frame 2 by suitable bearings and shafts, not shown, are a pair of expander arms 125. Also see FIG. *1a*. The expander arms rotate in the directions of arrows 127 about respective vertical axes in timed relationship with the propulsion of the container blanks 3. Each expander arm is dimensioned and located on the universal packer frame such that the leading edges 128 thereof enter the gaps G between the blank top and bottom flaps 41 and 45, respectively, created by the plows 117 and tabs 123. FIGS. *7e* and 8 show an expander arm just as the leading edge 128 thereof enters the gap G. The leading edge of each expander arm is wedge shaped, which facilitates entry of the expander arm into the interior of the blank between the top and bottom panels 31 and 35, respectively. The expander arm lower surfaces 130 slide along the inside surface 132 of the blank bottom panel, thereby restraining the bottom panel against the support rails 75. See FIG. *9a*.

The entry and rotation of the expander arms 125 between the blank top and bottom panels 31 and 35, respectively, spread those two panels apart, thereby unfolding the blank into a parallelogram shape. If necessary, the expander arms are able to break loose the top and bottom panels from each other against any adhesive inadvertently deposited on the inside surfaces of those two panels during blank manufacture. FIG. *8a* shows an expander arm as it leaves the interior of the blank.

While the expander arms 125 are inside the blank 3, a second device is acting on the blank to continue the unfolding process. Now looking at FIGS. *9a–9e*, the container panels 29, 31, 33, and 35 of a blank 3 are shown propelled along the support rails 75 in the downstream direction 15 by the stripper lugs 77. To continue the unfolding process begun by the expander arms 125, the present invention includes an erector device 129. The erector device 129 has a pair of arms 131 that rotate on a shaft 133 about a horizontal axis in the direction of arrow 135. The shaft 133 is located and rotates such that the arms 131 contact the blank trailing edge 59 just after the expander arms have entered between the blank top and bottom panels 31 and 35, respectively, to initially unfold the blank to a parallelogram shape. The shaft 133 rotates at a speed such that the expander arms push the trailing edge 59 in the downstream direction 15. The combination of the erecting arms 131 striking the blank trailing edge and the rotational speed of the expander arms, which is greater than the linear speed of the lugs 77, causes the blank to be pushed downstream slightly until the blank leading edge 57 strikes the back side 137 of the adjacent downstream lug *77a*, FIG. *9b*. At that point, the location of the blank leading edge is fixed. With the blank leading edge fixed, continued rotation of the erector device arms 131 against the blank trailing edge continues to unfold the blank, FIG. *9c*. Eventually the erector device arm breaks contact with the partially opened blank, FIG. *9d*.

To complete the blank unfolding process, the universal packer 1 employs the drop lug assemblies 95. Referring again to FIG. 6, one of a pair of cam tracks 139 is shown that is attached in any suitable manner to the universal packer frame 2. The cam tracks 139 are located to receive the cam followers 103 as the pairs of drop lug assemblies are carried on the upper flights of the chains 93 in the downstream direction 15. Each cam track slopes upwardly downstream in a curve 141 and eventually becomes parallel again to the chain 93 at downstream section 143. The curve 141 has the effect of forcing the drop lugs 97 to pivot about their respective pins 99 from the inoperative position of drop lug 95a to an operative position perpendicular to the chain 93, i.e., the drop lugs are vertically oriented, such as is represented by drop lug assembly 95b. Also looking at FIGS. *9a–9e*, the drop lug assemblies are located along the chains 93 such that a drop lug assembly is located under the trailing panel 33 of each blank 3 as the stripper lugs 77 propel the blanks in the downstream direction. Further, the location of the cam track curve 141 and the positions of the drop lug assemblies on the chains 93 are such that a pair of drop lugs pivots toward the operative vertical orientation in general unison with the overlying blank trailing panel.

After the erector arms 131 break contact with the partially opened blank, FIG. *9d*, the continued motion of the chains 93 completes the drop lug pivoting to the operative position against the blank trailing panel. Thus, in FIG. *9e*, the vertical drop lugs 97 are in operative contact with the opened container trailing panel 33 to capture the container 5 between the drop lug and the adjacent leading stripper lug *77a*. As best shown in FIG. 2, the unfolding process produces a longitudinal spacing 142 between consecutive unfolded containers 5. From the unfolding station 17, the containers 5 are propelled downstream by the chains 93, captured between the vertical drop lug assemblies 95 and the stripper lugs 77, to the flap control station 22.

Grouper Station

Figure 10:
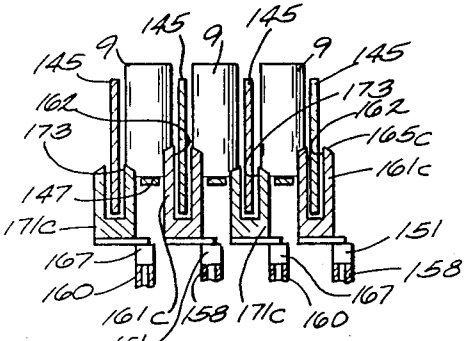
FIG. 10 is an enlarged cross sectional view taken along lines 10—10 of FIG. 3.

Now looking primarily at FIGS. 1, 3, and 10, the articles 9 to be loaded into the open containers 5 are fed to the grouper station 19 along two paths generally depicted at reference numerals 18. The structure and function of the various components along the two article paths 18 are identical. Accordingly, the components and functions associated with only one article path will be described.

The articles 9 in each path 18 are separated into the desired number of columns by vertical divider plates 145. In FIGS. 1 and 10, three columns of articles are depicted as comprising each path 18, but it will be appreciated that more or fewer columns are possible. The articless are supported on and are fed downstream by an infeed chain 147 associated with each column. Power is supplied in known and continuous fashion to the infeed chains 147 by a head shaft and sprocket 149. It is preferred that the speed of the infeed chains be slightly less, such as approximately 1.5 inches per minute less, than the speed of the chains 87 and 93 described previously in connection with the conveyor system 13 and unfolding station 17.

To form the massed articles 9 into complements 7 of the desired number, the grouper station 19 of the present invention includes a primary grouper 148, together with the pin and conveyor system 21. In the illustrated example of three columns of articles in each path 18, the primary grouper 148 comprises a pair of laterally spaced chains 151 for each article path 18. Each chain 151 is trained around a trio of sprockets on respective shafts 153, 155, and 157. Shaft 157 serves as the head shaft for driving sprockets 158 for the chains 151. The linear speed of the chains 151 is approximately one-half of the linear speed of the chains 87 and 93 used for propelling the blanks 3 and opened containers 5, respectively. Upstandingly mounted to the chains 151 at spaced intervals are a series of laterally aligned primary grouper pins 161. The primary grouper pins 161 on each chain 151 are located directly below respective divider plates 145. The primary grouper pins are formed with respective slots 162 that are aligned with and are sized to loosely pass under the associated divider plate 145. The chain ramp sections 163 between the shafts 153 and 155, the primary grouper pins 161, and the spacing between the primary grouper pins are designed such that the tips 165 of aligned primary grouper pins, such as tips 165*a* of primary grouper pins 161*a*, pass under the respective divider plates 145 and penetrate upwardly between adjacent articles 9 and 9*a* as the next consecutive downstream primary grouper pins 161*b* reach the ends of the chain ramp sections 163. Consequently, a complement, such as complement 7*a*, of articles is captured between consecutive primary grouper pins 161*a* and 161*b*. Similarly, complement 7*b* was previously captured between primary grouper pins 161*b* and 161*c*. The complements are propelled downstream by the chains 151 and the associated primary grouper pins 161 until the primary grouper pins are over the sprocket 158 and shaft 157.

In the preferred embodiment, the pin and chain system 21 comprises a secondary grouper 166 associated with each article path 18. Each secondary grouper 166 has a pair of laterally spaced chains 167 trained around sprockets on shafts 153, 157, and 170. Sprockets 160 on shaft 157 are idler sprockets. Power is supplied to the chains 167 by respective drive sprockets 169 and shaft 170 at the same speed as the stripper lugs 77 and drop lug assemblies 95 that propel the blanks 3 and open containers 5, respectively, as previously explained. The secondary grouper chains 167 travel at a speed approximately twice that of the primary grouper chains 151. For example, the linear speed of the primary grouper chains 151 may be approximately 9.75 inches per minute, and the speed of the secondary grouper chains 167 and the conveyor section chains 87 and 93 may be approximately 18 inches per minute.

Secondary grouper pins 171 upstandingly connected to the respective chains 167 are spaced apart approximately twice as far as the spacing between the primary grouper pins 161 of the primary grouper 148. The secondary grouper pins 171 are shorter than the primary grouper pins 161. The secondary grouper pins are designed with respective slots 173 to pass alongside the divider plates 145. Only when the secondary grouper pins reach the shaft 157 and sprockets 160 do those pins, such as pins 171*c*, emerge from along the ramp sections 175 of the chains 167. At that point, the secondary grouper pin slots 173 pass alongside the divider plates, and the pins penetrate upwardly between the complements 7*b* and 7*c* formed previously by the primary grouper 148. At point 177, the secondary grouper pins 171 contact the complement there, such as complement 7*c*, to propel it downstream. Point 177 thus serves as a transfer point, because propulsion of the complement 7*c* is transferred at that point from the primary grouper 148 to the secondary grouper 166. Simultaneously, the secondary grouper pins 171 accelerate the complement 7*c* downstream to the speed of the blanks 3 and open containers 5. The transfer point 177 is laterally aligned just slightly downstream of the trailing panel 33 of an open container 5. Accordingly, the complements propelled in downstream direction 15 by the secondary grouper are laterally aligned with the open sides of the respective containers. The acceleration of the complements by the secondary grouper produces a longitudinal spacing 178 between consecutive complements.

Figure 11:
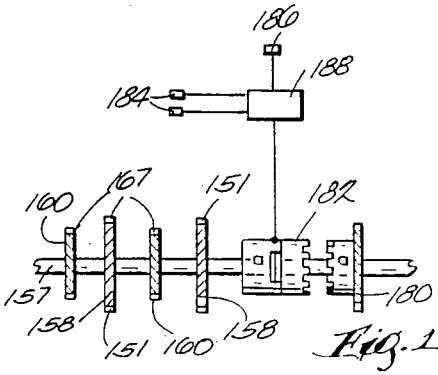
FIG. 11 is an enlarged partially schematic view taken along lines 11—11 of FIG. 3.
Figure 7E:
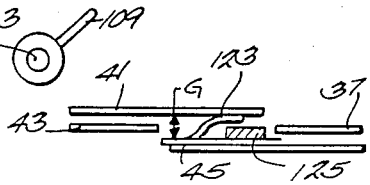

It is a feature of the present invention that the primary grouper 148 does not necessarily operate continuously. Rather, power is supplied on an interruptable basis to the shaft 157 for driving the sprockets 158. Looking also at FIG. 11, reference numeral 180 represents an input drive used in connection with a clutch mechanism, such as a Warner PSI clutch schematically depicted at reference numeral 182. In FIGS. 1 and 11, reference numeral 184 represents sensors for sensing the presence of an adequate number of articles 9 arriving at the grouper station 19. A similar sensor 186 senses the presence of a blank 3 at the unfolding station 17. Signals from the sensors 184 and 186 are fed to a suitable control schematically depicted at reference numeral 188. If the sensors 184 and 186 sense a blank at the unfolding station and sufficient articles 9 at the grouper station 19, the control 188 actuates the clutch mechanism 182 to engage and enable the input drive 180 to drive the shaft 157 and sprockets 158. As long as a blank 3 and sufficient articles 9 are sensed, the clutch mechanism will continuously drive the primary grouper 148 to form the complements 7 and to propel them to the transfer point 177. However, if any of the sensors 184 or 186 sense that a blank or a sufficient number of articles is missing, the control 188 actuates the clutch mechanism to open and to stop the primary grouper. Thus, if conditions warrant, the clutch mechanism can operate on an intermittent basis.

On the other hand, the secondary grouper 166 operates continuously. However, since the secondary grouper pins 171 can contact and accelerate a complement 7 only at the transfer point 177, no complement can be propelled downstream therefrom unless the primary grouper clutch mechanism 182 has previously been engaged to enable the primary grouper 148 to propel a complement to the transfer point. In that manner, the secondary grouper can operate continuously, even though the primary grouper may be operated intermittently.

Pusher Bar System

From the grouper station 19, the complements 7 of articles 9 are propelled by the secondary grouper 166 to the pusher bar system 23. Simultaneously, the open containers 5 are propelled downstream in transverse alignment with the complements by the conveyor system 13 to the pusher bar system. Referring primarily to FIGS. 1–3, the pusher bar system comprises a pair of laterally spaced chains 179 trained around suitable sprockets and shafts 181 located generally above the article paths 18. Spaced at intervals along the chains 179 and attached thereto are a series of elongated pusher bars 183. Each pusher bar 183 is composed of a relatively narrow center section 185 interposed between and connected to a pair of relatively wide end plates 187. The pusher bars 183, chains 179, and sprockets 181 are designed and operated such that a pusher bar center section 185 enters vertically into the space 142 between consecutive containers 5, and the end plates 187 enter into the space 178 between consecutive complements 7 as the complements and containers are propelled in the downstream direction 15. The leading edges 191 of the pusher bar end plates 187 are located to contact the complements just as the secondary grouper pins 171 pass over the head shaft sprockets 169 and return to the tail shaft 153. Consequently, propulsion of the complements is transferred from the secondary grouper pins 171 to the pusher bar end plates. The containers 5 remain propelled by the drop lug assemblies 95 on the chains 93.

Flap Control Station

Further in accordance with the present invention, the pusher bar system 23 is employed to assist in positively controlling the container flaps 37 and 43 at the flap control station 22. Although not shown in FIGS. 1–3, it will be recalled that the container bottom flaps 45 remain under the control of the plows 117, as was explained previously in regard to the unfolding of the blanks 3 in connection with FIGS. *7a–7e*. Positive control of the trailing flaps 43 is achieved by means of a pair of cams 193 mounted to the universal packer frame 2 in a suitable manner. Each cam 193 has a face 195 that is struck by the associated trailing flap as the container 5 is propelled downstream past the cam. As a result, the trailing flaps are bent backwardly along respective fold lines 49, such that they become approximately parallel to the direction 15 of downstream travel. The cams 193 are so located on the universal packer frame relative to the travel of the pusher bars 183 that the cam faces 195 slightly bend the trailing flap free ends to tuck them into respective vertical slots 197 in the pusher bar center section 185. Consequently, the trailing flaps of the containers are positively restrained in place by the adjacent following pusher bar.

To positively control and locate the container top flaps 41, a pair of cams 199 are mounted to the universal packer frame 2 by appropriate brackets 201. The container top flaps strike the cams 199 and are bent upwardly along respective fold lines 47 to a vertical orientation.

To control the container leading flaps 37, the universal packer 1 of the present invention is provided with a flap tucker mechanism 203. The flap tucker mechanism 203 comprises a horizontal shaft 205 mounted in the universal packer frame 2 for rotation in the direction of arrow 206. Fastened to the shaft 205 are a pair of disks 207. Each disk 207 is located such that a face 208 thereof is in close proximity to the inside surface 210 of a top flap 41, which was previously bent to the vertical orientation by the associated cam 199. Joined to each disk 207 is a rod 209. The rotation of the shaft 205 and the placement of the rods 209 on the disks are designed in relation to the downstream motion of the containers 5 such that the rods bend the associated leading flaps to a fully opened configuration approximately parallel to the direction 15 of container motion. To positively restrain the leading flaps in the fully opened configuration, each pusher bar 183 includes a pair of fingers 211. Each finger 211 is positioned relative to the adjacent following container such that the leading flap that was bent fully opened by the tucker mechanism 203 is captured by the respective pusher bar finger. That is, as the tucker mechanism rod rotates, it slightly bends the leading flap against the associated finger and then tucks it behind the finger. A second pair of plows 212 mounted to the universal packer frame 2 by brackets, not shown, maintain the top flaps under control after the container has passed the tucker mechanism 203. The plows 117 and 212 continue downstream from the flap control station 22 to continue restraining the carton bottom and top flaps, respectively, although, for clarity in FIG. 1, those plows are only partially shown. At that point, all of the container flaps are under positive restraint at known and controlled locations.

Loading Station

The containers 5 leave the flap control station 22, propelled by the drop lug assemblies 95 and associated chains 93, with the flaps 37, 41, 43, and 45 under full control. Simultaneously, a complement 7 of articles 9 is located transversely of each side of and traveling in unison with a respective container. The complements are propelled by the leading edges 191 of the pusher bars 183. Downstream of the flap control station, the divider plates 145 converge toward each other. Consequently, the complements are forced toward the container as they continue to be propelled downstream. Ultimately, the complements are forced by the cooperation of the pusher bar plates and divider plates completely into the container through both the open sides thereof, thereby creating the filled containers 214. Complete loading occurs upstream of the downstream end 213 of the pusher bar system 23 at which the pusher bars 183 rise out of the spacings 142 between consecutive containers. Upstream a short distance from the pusher bar system downstream end 213, the conveyor section chains 87 and 93 pass around the head shaft 216, and the support rails 75 terminate. Support and propulsion of the filled containers 214 is transferred to a conventional conveyor 218.

After the pusher bars 183 rise out of the spacings 142 between consecutive filled containers 214, the container trailing flaps 43 are no longer restrained by the pusher bar slots 197. Similarly, the container leading flaps 37 are no longer controlled by the pusher bar fingers 211. Also, the plows 117 and 212 terminate under the downstream end 213 of the pusher bar system 23. As a result, all four flaps on each end of the container become unrestrained and are free to be bent about their respective fold lines 39, 47, 49, and 51. The leading flaps may be closed by respective cams 215 attached to the universal packer frame 2.

To control the container trailing flaps 43, a closer mechanism 217 is employed. In the illustrated construction, the closer mechanism 217 comprises a pair of chains 219 trained around respective pairs of sprockets 221. The sprockets 221 rotate to drive the chains in a horizontal plane at a high speed in the direction of arrows 223. Connected to each chain 219 is a closing finger 225. The travel of the closing fingers 225 is timed relative to the motion of the filled containers 214 such that the closing fingers strike the trailing flaps 43 and bend them forwardly along their respective fold lines 49 to the closed configuration. The container top and bottom flaps 31 and 35, respectively, are folded by conventional closing plows, not illustrated in the drawings, in known fashion.

Glue is applied in a normal manner to the inside surfaces of the top and bottom flaps 41 and 45, respectively, before those flaps are fully closed. Thereafter, the filled and closed containers 214 are propelled by the conveyor 218 further downstream to known compression, inspection, and shipping stations, not illustrated.

Thus, it is apparent that there has been provided, in accordance with the invention, a universal packer that fully satisfies the aims and advantages set forth above. While the invention has been described in conjunction with specific embodiments thereof, it is evident that many alternatives, modifications, and variations will become apparent to those skilled in the art. Accordingly, it is intended to embrace all such alternatives, modifications, and variations as fall within the spirit and broad scope of the appended claims.

I claim:

1. A universal packer comprising:

a. an elongated frame;

b. conveyor means for propelling open side container blanks in a downstream direction along the frame in an unfolding path, the blanks being supported by the frame and having foldable flaps, the blanks having leading and trailing edges;

c. metering means for controlling the supply of folded container blanks to the conveyor means, wherein the metering means comprises:

i. a hopper for holding a vertical stack of blanks;

ii. lip means for supporting a first quantity of blanks in the hopper above the conveyor means;

iii. ledge means for selectively holding a second quantity of blanks above and out of contact with the first quantity of blanks and releasing the second quantity of blanks to fall onto the first quantity of blanks on the lip means; and iv. gripping means for selectively holding a third quantity of blanks above and out of contact with the second quantity of blanks and releasing the third quantity of blanks to fall onto and be supported by the ledge means;

d. unfolding means for cooperating with the conveyor means to unfold the blanks into open side containers;

e. infeed means for feeding quantities of articles along at least one path in the downstream direction adjacent to the conveyor means;

f. grouper means for forming complements of a desired number of articles and for propelling the complements in the downstream direction in unison and alignment with and in transverse alignment with respective open containers;

g. pusher bar means for propelling the complements of articles downstream in unison and alignment with the open containers subsequent to the propulsion thereof by the grouper means;

h. flap control means downstream of the unfolding means for positively restraining al the flaps of the open containers in respective controlled locations; and i. means for loading the complements into respective open containers, so that the ledge means and gripper means cooperate to control the quantity of blanks supported by the lip means.

2. The universal packer of claim 1 wherein the gripping means comprises:

a. a second cylinder mounted to the hopper above the ledge means; and b. a gripper connected to the second cylinder and selectively reciprocated thereby between a retracted position where the gripper is outside the hopper and an extended position where the gripper is inside the hopper to grip at least some of the third quantity of blanks and to support the third quantity of blanks above the ledge means.

3. A universal packer comprising:

a. an elongated frame;

b. conveyor means for propelling open side container blanks in a downstream direction along the frame in an unfolding path, the blanks being supported by the frame and having foldable flaps, the blanks having leading and trailing edges;

c. unfolding means for cooperating with the conveyor means to unfold the blanks into open side containers, wherein the unfolding means comprises:

i. unfolding arm means for bending selected container blank flaps relative to the frame;

ii. expander means for entering into the interior of the container blank to partially unfold the blank; and iii. erector means for contacting a partially unfolded blank to continue unfolding the blank;

d. infeed means for feeding quantities of articles along at least one path in the downstream direction adjacent the conveyor means;

e. grouper means for forming complements of a desired number of articles and for propelling the complements in the downstream direction in unison and alignment with and in transverse alignment with respective open containers;

f. pusher bar means for propelling the complements of articles downstream in unison and alignment with the open containers subsequent to the propulsion thereof by the grouper means;

g. flap control means downstream of the unfolding means for positively restraining all the flaps of the open containers in respective controlled locations;

h. means for loading the complements into respective open containers; and i. plow means for cooperating with the unfolding arm means to control the location of the selected container blank flaps after the flaps have been bent by the unfolding arm means, wherein:

i. the plow means comprises at least one elongated plow mounted to the frame for restraining the location of a first container blank flap in a first predetermined location, and tab means fixed to the plow for restraining a second container blank flap in a second predetermined location, the plow and tab means cooperating to create a gap between the first and second flaps; and ii. the expander means enters the interior of the blank through the gap between the first and second flaps.

4. The universal packer of claim 3 wherein the erector means comprises at least one arm mounted in the frame for rotation in timed relation with the conveyor means and the expander means to contact the container blank trailing edge after the expander means has entered into the interior of the blank to partially unfold the blank.

5. A universal packer comprising:

a. an elongated frame;

b. conveyor means for propelling open side container blanks in a downstream direction along the frame in an unfolding path, the blanks being supported by the frame and having foldable flaps, the blanks having leading and trailing edges;

c. unfolding means for cooperating with the conveyor means to unfold the blanks into open side containers, wherein the unfolding means comprises:

i. unfolding arm means for bending selected container blank flaps relative to the frame;

ii. expander means for entering into the interior of the container blank to partially unfold the blank; and iii. erector means for contacting a partially unfolded blank to continue unfolding the blank, and wherein the conveyor means comprises drop lug means for completing the unfolding of the partially open blank, wherein the drop lug means comprises:

i. first chain means for traveling in the downstream direction along the unfolding path;

ii. at least one drop lug assembly pivotally attached to the first chain means and being in close proximity to a container blank; and iii. track means mounted to the frame for pivoting the drop lug assembly between an inoperative positive wherein the drop lug assembly is out of contact with the blank and in close proximity thereto and an operative position wherein the drop lug assembly contacts the partially unfolded blank and completes unfolding the blank;

d. infeed means for feeding quantities of articles along at least one path in the downstream direction adjacent the conveyor means;

e. grouper means for forming complements of a desired number of articles and for propelling the complements in the downstream direction in unison and alignment with and in transverse alignment with respective open containers;

f. pusher bar means for propelling the complements of articles downstream in unison and alignment with the open containers subsequent to the propulsion thereof by the grouper means;

g. flap control means downstream of the unfolding means for positively restraining all the flaps of the open containers in respective control locations; and h. means for loading the complements into respective open containers.

6. The universal packer of claim 5 wherein the drop lug assembly propels the opened container in the downstream direction subsequent to the complete unfolding of the container.

7. A universal packer comprising:

a. an elongated frame;

b. conveyor means for propelling open side container blanks in a downstream direction along the frame in an unfolding path, the blanks being supported by the frame and having foldable flaps, the blanks having leading and trailing edges;

c. unfolding means for cooperating with the conveyor means to unfold the blanks into open side containers;

d. infeed means for feeding quantities of articles along at least one path in the downstream direction adjacent the conveyor means;

e. grouper means for forming complements of a desired number of articles and for propelling the complements in the downstream direction in unison and alignment with and in transverse alignment with respective open containers, wherein the grouper means comprises:

i. primary grouper means for forming complements of a desired number of articles and for propelling the complements along the article path to a transfer point; and ii. secondary grouper means for contacting the complements at the transfer point and for propelling the complements along the article path;

f. pusher bar means for propelling the complements of articles downstream in unison and alignment with the open containers subsequent to the propulsion thereof by the grouper means;

g. flap control means downstream of the unfolding means for positively restraining all the flaps of the open containers in respective control location; and h. means for loading the complements into respective open containers.

8. A universal packer comprising:

a. an elongated frame;

b. conveyor means for propelling open side container blanks in a downstream direction along the frame in an unfolding path, the blanks being supported by the frame and having foldable flaps, the blanks having leading and trailing edges;

c. unfolding means for cooperating with the conveyor means to unfold the blanks into open side containers;

d. infeed means for feeding quantities of articles along at least one path in the downstream direction adjacent the conveyor means;

e. group means for forming complements of a desired number of articles and for propelling the complements in the downstream direction in unison and alignment with and in transverse alignment with respective open containers;

f. pusher bar means for propelling the complements of articles downstream in unison and alignment with the open containers subsequent to the propulsion thereof by the grouper means, wherein the pusher bar means comprises:

i. second chain means located generally above the article path; and ii. a plurality of pusher bars attached to the second chain means, each pusher bar having a plate section with a leading edge for propelling the complements of articles along the article path;

g. flap control means downstream of the unfolding means for positively restraining al the flaps of the open containers in respective controlled locations; and h. means for loading the complements into respective open containers.

9. The universal packer of claim 8 wherein each pusher bar further comprises a center section joined to the plate section, the center section being located between and adjacent consecutive containers, the pusher bar center section having a leading edge that is non-colinear with the plate section leading edge, the pusher bar center section being spaced from the consecutive containers to thereby leave the containers free for being propelled in the downstream direction by the conveyor means.

10. The universal packer of claim 9 wherein:

a. the flap control means comprises cam means mounted to the frame for striking a third selected flap on the open container as the container is propelled downstream and for bending the third selected flap into a direction approximately parallel to the downstream direction; and b. the pusher bar center section defines at least one slot located to receive and restrain the third selected flap bent by the cam means, so that the third selected flap is tucked into and positively restrained in a controlled location in the pusher bar slot.

11. The universal packer of claim 9 wherein:

a. the flap control means comprises rod means mounted in the frame for bending a fourth selected container flap into a direction approximately parallel to the downstream direction; and b. the pusher bar comprises at least one finger mounted on the pusher bar center section and located thereon to restrain the fourth selected flap bent by the rod means, so that the fourth selected flap is restrained in a controlled location by the pusher bar finger.

12. The universal packer of claim 10 further comprising closer means mounted to the frame for closing the third selected container flap, the closer means comprising:

a. third chain means for traveling in a downstream direction; and b. a closing finger mounted to the third chain means for movement therewith in timed relation to the downstream motion of the container to strike the third selected flap thereof and to bend the third selected flap into a closed configuration.

13. Apparatus for unfolding open side container blanks having leading, top, trailing and bottom panels and a pair of flaps joined to and extending oppositely from each respective panel and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. metering means for supplying carton blanks to the conveyor means comprising a hopper for receiving and storing a stack of container blanks and located above the conveyor means, the hopper being fabricated with lip means for supporting the blanks within the hopper, and blank control means mounted to the hopper for controlling the quantity of blanks supported by the lip means, wherein the blank control means comprises:

i. ledge means mounted to the hopper for selectively holding a predetermined quantity of blanks and for dropping the predetermined quantity of blanks onto the hopper lip means; and ii. gripper means mounted to the hopper above the ledge means for defining the quantity of blanks supported and dropped by the ledge means onto the hopper lip means;

d. unfolding means for unfolding the blanks into open containers;

e. grouper means associated with each article path for forming complements of articles and for propelling them in the downstream direction in unison with and alignment with respective open containers;

f. flap control means for positively controlling the locations of the container flaps; and g. means for loading the complements into the open side containers.

14. Apparatus for unfolding open side container blanks having leading, top, trailing, and bottom panels and a pair of flaps jointed to and extending oppositely from each respective panels and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers, wherein the unfolding means comprises:

i. expander means mounted in the frame for entering between the container blank top and bottom panels to partially unfold the blank into a parallelogram shape;

ii. erector means mounted in the frame for continuing unfolding the container blank partially unfolded by the expander means; and iii. drop lug means traveling in unison with the conveyor means for completing the unfolding of the blanks;

d. grouper means associated with each article path for forming complements of articles and for propelling them in the downstream direction in unison with and aligned with respective open containers;

e. flap control means for positively controlling the locations of the container flaps; and f. means for loading the complements into the open side containers.

15. Apparatus for unfolding open side container blanks having leading, top, trailing, and bottom panels and a pair of flaps joined to and extending oppositely from each respective panel and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers, wherein the unfolding means comprises:

i. expander means mounted in the frame for entering between the container blank top and bottom panels to partially unfold the blank into a parallelogram shape;

ii. erector means mounted in the frame for continuing unfolding the container blank partially unfolded by the expander means; and iii. drop lug means traveling in unison with the conveyor means for completing the unfolding of the blanks;

d. means for creating a gap between the container blank top and bottom flaps to thereby facilitate entry of the expander means between the top and bottom panels, wherein the means for creating a gap between the blank top and bottom flaps comprises:

i. unfolding means for bending the blank top and bottom flaps in a first direction relative to their respective panels;

ii. plow means fastened to the frame for positively restraining the blank bottom flaps in their respective first bent directions; and iii. tab means associated with the plow means for bending the blank top flaps in a second direction opposite the first direction to thereby create the gap between the top and bottom flaps for entry of the expander means;

e. grouper means associated with each article path for forming complements of articles and for propelling them in a downstream direction in unison with and aligned with respective open containers;

f. flap control means for positively controlling the locations of the container flaps; and g. means for loading the complements into the open side containers.

16. Apparatus for unfolding open side container blanks having leading, top, trailing, and bottom panels and a pair of flaps jointed to and extending oppositely from each respective panel and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers, wherein the unfolding means comprises:

i. expander means mounted in the frame for entering between the container blank top and bottom panels to partially unfold the blank into a parallelogram shape, wherein the expander means comprises a pair of expander arms rotatably mounted in the frame for rotation about respective vertical axes, the expander arms rotating in timed relation to the conveyor means to enter between the container blank top and bottom panels and partially unfold the blank into the parallelogram shape and thereby raise the blank trailing edge off the frame;

ii. erector means mounted in the frame for continuing unfolding the container blank partially unfolded by the expander means, wherein the erector means comprises at least one erector arm mounted for rotation about a horizontal axis in timed relation to the propulsion of the container blank by the conveyor means to contact the blank trailing edge after the expander arms have partially unfolded the blank and cooperate with the conveyor means to continue unfolding the container blank; and iii. drop lug means traveling in unison with the conveyor means for completing the unfolding of the blanks;

d. grouper means associated with each article path for forming complements of articles and for propelling them in the downstream direction in unison with and aligned with respective open containers;

e. flap control means for positively controlling the locations of the container flaps; and f. means for loading the complements into the open side containers.

17. The apparatus of claim 16 wherein the drop lug means comprises:

a. first chain means supported by the frame for traveling in the downstream direction in unison with the conveyor means; and b. a plurality of spaced drop lug assemblies pivotally mounted to the first chain means for being carried in the downstream direction thereby, each drop lug assembly being located generally aligned with the trailing panel of a respective container blank propelled by the conveyor means, each drop lug assembly being pivotable between an inoperative position wherein it underlies the blank trailing panel and an operative position wherein it contacts the trailing panel and cooperates with the conveyor means to complete unfolding the blank.

18. The apparatus of claim 17 further comprising track means mounted to the frame for forcing the drop lug assemblies to pivot from their respective inoperative positions to the operative positions as the drop lug assemblies are carried in the downstream direction by the first chain means.

19. Apparatus for unfolding open side container blanks having leading, top, trailing, and bottom panels and a pair of flaps joined to and extending oppositely from each respective panel and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers, wherein the unfolding means comprises expander means mounted in the frame for entering between the container blank top and bottom panels to partially unfold the blank into a parallelogram shape, erector means mounted in the frame for continuing unfolding the container blank partially unfolded by the expander means, and drop lug means traveling in unison with the conveyor means for completing the unfolding of the blanks, wherein the drop lug means comprises:

i. a plurality of drop lug assemblies;

ii. chain means supported by the frame for pivotally mounting the drop lug assemblies thereon at spaced intervals therealong and for carrying the drop lug assemblies in the downstream direction; and iii. track means mounted to the frame for pivoting the drop lug assemblies from respective inoperative positions to operative positions as the drop lug assemblies are carried downstream by the chain means, the track means being located in relation to the erector means to pivot a drop lug assembly into contact with the trailing panel of a respective partially unfolded blank and to complete unfolding the blank as the drop lug assembly is pivoted to the operative position;

d. grouper means associated with each article path for forming complements of articles and for propelling them in the downstream direction in unison with and aligned with respective open containers;

e. flap control means for positively controlling the locations of the container flaps; and f. means for loading the complements into the open side containers.

20. Apparatus for unfolding open side container blanks having leading, top, trailing, and bottom panels and a pair of flaps joined to and extending oppositely from each respective panel and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers;

d. grouper means associated with each article path for forming complements of articles and for propelling them in the downstream direction in unison with and aligned with respective open containers, wherein the grouper means associated with each article path comprises:

i. a primary grouper comprising a plurality of primary grouper pins; and primary chain means mounted in a vertical plane on the frame for carrying the primary grouper pins in the downstream direction, the primary chain means being located to cause the primary grouper pins to penetrate vertically between the articles at a predetermined location thereof along the article path to form a complement of the desired number of articles and to propel the complement in the downstream direction to a transfer point; and ii. a secondary grouper comprising a plurality of secondary grouper pins; and secondary chain means for carrying the secondary grouper pins in the downstream direction, the secondary chain means being located to cause the secondary grouper pins to contact the complement of articles at the transfer point and to propel the complement in the downstream direction;

e. flap control means for positively controlling the locations of the container flaps; and f. means for loading the complements into the open side containers.

21. The apparatus of claim 20 wherein the primary grouper operates on an intermittent basis, and wherein the secondary grouper operates on a continuous basis.

22. The apparatus of claim 20 wherein the secondary chain means operates at a speed greater than the speed of the primary chain means.

23. Apparatus for unfolding open side container blanks having leading, top, trailing, and bottom panels and a pair of flaps joined to and extending oppositely from each respective panel and for loading the open containers with complements of articles comprising:

a. an elongated frame that define a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers;

d. grouper means associated with each article path for forming complements of articles and for propelling them in the downstream direction in unison with and aligned with respective open containers;

e. pusher bar means for propelling the complements of articles in the downstream direction subsequent to the propulsion thereof by the grouper means, wherein the pusher bar means comprises:

i. a plurality of pusher bars, each pusher bar comprising a pair of plates and a center section interposed between and connecting the plates, the plates being formed with leading edges for propelling the complements in the downstream direction, the center section being formed with a leading edge that is non-colinear with the leading edges of the plates; and ii. pusher bar chain means for locating the pusher bar plates in alignment with the article paths and for carrying the pusher bars in the downstream direction in timed relation with the conveyor means and grouper means to locate the pusher bar center sections between and spaced from consecutive containers to leave the containers free to be propelled by the conveyor means and to locate the pusher bar plates between and in contact with consecutive complements;

f. flap control means for positively controlling the locations of the container flaps; and g. means for loading the complements into the open side containers.

24. The apparatus of claim 23 wherein:

a. each pusher bar defines a pair of vertical slots and a pair of fingers; and b. the flap control means comprises:

i. cam means mounted to the frame for bending the container trailing flaps into a direction generally parallel to the downstream direction and for tucking the trailing flaps into respective slots in the adjacent pusher bar; and ii. rod means mounted to the frame for bending the container leading flaps into a direction generally parallel to the downstream direction and for tucking the leading flaps into engagement with the fingers of the adjacent pusher bar, so that the pusher bars positively restrain the container leading and trailing flaps in respective controlled locations.

25. Apparatus for unfolding open side container blanks having leading, top, trailing, and bottom panels and a pair of flaps joined to and extending oppositely from each respective panel and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers;

d. grouper means associated with each article path for forming complements of articles and for propelling them in the downstream direction in unison with and aligned with respective open containers;

e. flap control means for positively controlling the locations of the container flaps, wherein the flap control means comprises:

i. first tucker means mounted to the frame for folding the container trailing flaps in a direction generally parallel to the downstream motion; and ii. pusher bar means traveling in the downstream direction in unison with the conveyor means and located between consecutive containers propelled thereby for receiving the container trailing flaps and for restraining them in respective controlled locations; and f. means for loading the complements into the open side containers.

26. Apparatus for unfolding open side container blanks having leading, top, trailing, and bottom panels and a pair of flaps joined to and extending oppositely from each respective panel and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers;

d. grouper means associated with each article path for forming complements of articles and for propelling them in the downstream direction in unison with and aligned with respective open containers;

e. flap control means for positively controlling the locations of the container flaps, wherein the flap control means comprises:

i. second tucker means mounted to the frame for folding the container leading flaps into a direction generally parallel to the downstream direction; and ii. pusher bar means traveling in the downstream direction in unison with the conveyor means and located between consecutive containers propelled thereby for receiving the container leading flaps and for restraining them in respective controlled locations; and f. means for loading the complements into the open side containers.

27. Apparatus for unfolding open side container blanks having leading, top, trailing, and bottom panels and a pair of flaps joined to and extending oppositely from each respective panel and for loading the open containers with complements of articles comprising:

a. an elongated frame that defines a pair of parallel paths for the articles;

b. conveyor means located between the pair of article paths for propelling the blanks in a downstream direction to thereby create blank leading and trailing edges, the blank trailing and bottom panels being supported by the frame;

c. unfolding means for unfolding the blanks into open containers;

d. grouper means associated with each article path for forming complements of articles and for propelling them in the downstream direction in unison with and aligned with respective open containers;

e. flap control means for positively controlling the locations of the container flaps;

f. means for loading the complements into the open side containers; and g. closer means for closing the container trailing flaps, the closer means comprising:

i. closer chain means for traveling in a downstream direction; and ii. closer finger means carried by the closer chain means in timed relation to the downstream motion of the container to strike the container trailing flaps and to bend them to their respective closed configurations.

* * * * *

UNITED STATES PATENT AND TRADEMARK OFFICE

CERTIFICATE OF CORRECTION

PATENT NO. : 4,982,551

DATED : January 8, 1991

INVENTOR(S) : Biagio J. Nigrelli, Sr.

It is certified that error appears in the above-identified patent and that said Letters Patent is hereby corrected as shown below:

On the title page the Assignee should read --- Nigrelli Systems, Inc. ---.

Column 14, Line 6 (Claim 1):
Delete "al" and substitute --- all ---.

Column 14, Line 20 (Claim 2):
After "outside" insert --- of ---.

Column 15, Line 44 (Claim 5):
Delete "positive" and substitute --- position ---.

Column 16, Line 68 (Claim 8):
Delete "al" and substitute --- all ---.

Column 18, Line 23 (Claim 14):
Delete "jointed" and substitute -- joined ---.

Column 19, Line 38 (Claim 16):
Delete "jointed" and substitute --- joined ---.

UNITED STATES PATENT AND TRADEMARK OFFICE

CERTIFICATE OF CORRECTION

PATENT NO. : 4,982,551

DATED : January 8, 1991

INVENTOR(S) : Biagio J. Nigrelli, Sr.

It is certified that error appears in the above-identified patent and that said Letters Patent is hereby corrected as shown below:

Column 22, Line 6 (Claim 23):
Delete "define" and substitute ---defines---.

Signed and Sealed this

Fifth Day of May, 1992

*Attest:*

DOUGLAS B. COMER

*Attesting Officer*

*Acting Commissioner of Patents and Trademarks*